US006209685B1

(12) United States Patent
Zaharia et al.

(10) Patent No.: US 6,209,685 B1
(45) Date of Patent: Apr. 3, 2001

(54) SELECTIVE, AUTOMATIC ELEVATOR CALL REGISTERING SYSTEM

(75) Inventors: Vlad Zaharia, Rocky Hill; Paul A. Stranieri, Bristol, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/326,102

(22) Filed: Jun. 4, 1999

(51) Int. Cl.[7] ..... B66B 3/00
(52) U.S. Cl. ..... 187/392; 187/381; 187/388
(58) Field of Search ..... 187/380, 381, 187/382, 384, 386, 387, 388, 391, 392

(56) References Cited

U.S. PATENT DOCUMENTS

| | | | | |
|---|---|---|---|---|
| 4,685,538 | | 8/1987 | Kamaike . | |
| 4,979,594 | | 12/1990 | Begle et al. . | |
| 5,554,832 | * | 9/1996 | Lumme et al. | 187/380 |
| 5,749,443 | * | 5/1998 | Romao | 187/384 |
| 5,949,037 | * | 9/1999 | Oya | 187/392 |
| 5,952,626 | * | 9/1999 | Zaharia | 187/381 |
| 5,984,051 | * | 11/1999 | Morgan et al. | 187/392 |
| 6,109,396 | * | 8/2000 | Sirag et al. | 187/381 |

FOREIGN PATENT DOCUMENTS

| | | | |
|---|---|---|---|
| 196 08 382 A1 | 11/1997 | (DE) | B66B/1/14 |
| 0 879 782 A1 | 5/1998 | (EP) | B66B/1/46 |

* cited by examiner

*Primary Examiner*—Jonathan Salata

(57) ABSTRACT

Each elevator corridor of an elevator system has a transponder beacon disposed near each access to the corridor, each potential passenger, including regular tenants and visitors, carries a responder, such as an RFID responder, so as to provide an indication of entrance into and exit from the elevator corridor. Passengers that are not visitors have a history developed as to the likely travel route of each passenger as the passenger enters the elevator lobby; that is, whether the passenger is likely to take the elevator at this time, or likely to exit the elevator corridor to some other facility. Entered calls can be cancelled if the passenger leaves the lobby, and passenger travel patterns are updated with each passage through the elevator lobby.

5 Claims, 1 Drawing Sheet

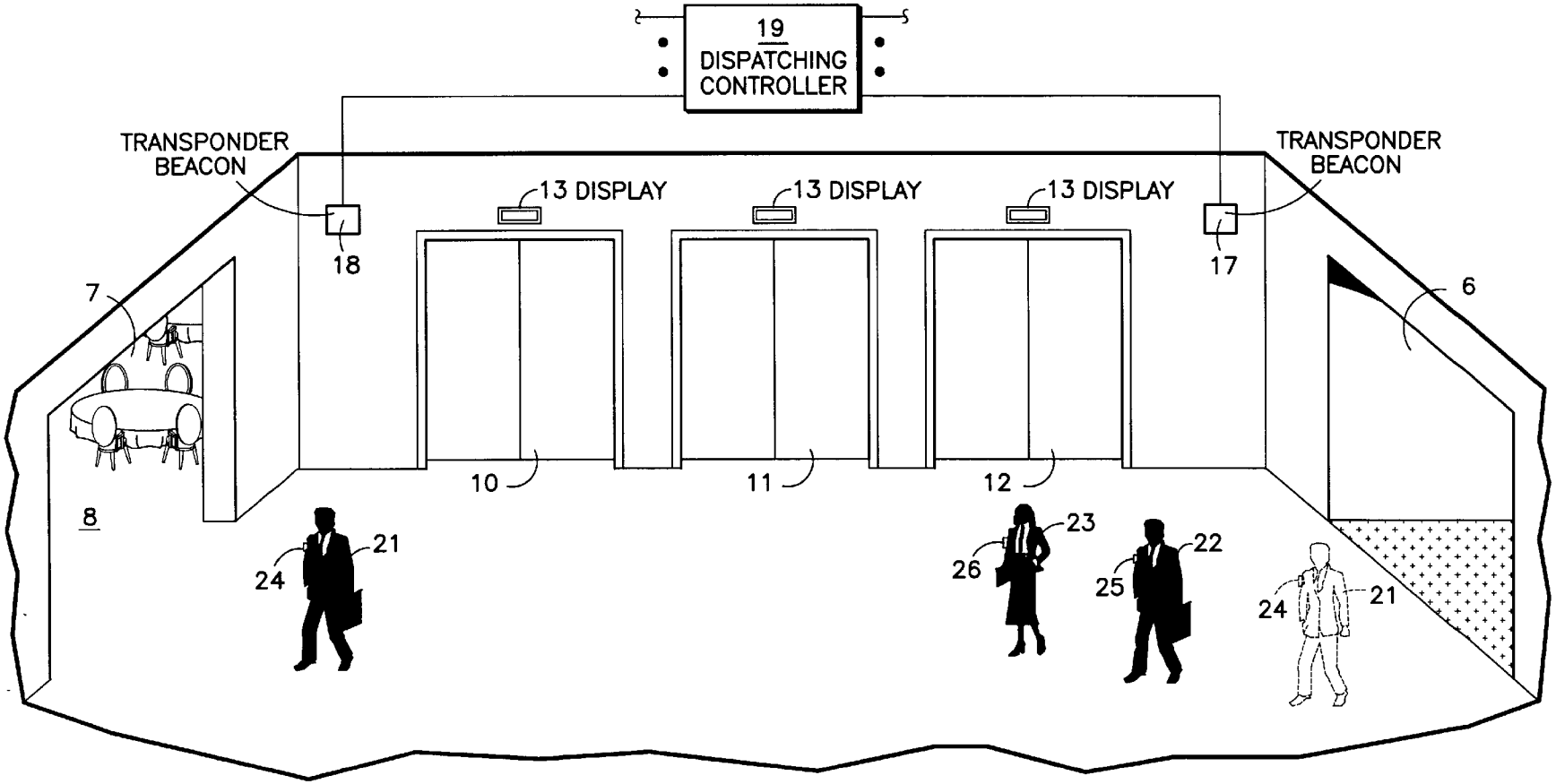
19
DISPATCHING CONTROLLER
TRANSPONDER BEACON
17
TRANSPONDER BEACON
18
13 DISPLAY
13 DISPLAY
13 DISPLAY
10
11
12
6
7
8
21
22
23
24
25
26

SELECTIVE, AUTOMATIC ELEVATOR CALL REGISTERING SYSTEM

TECHNICAL FIELD

This invention relates to selective automatic registering of elevator calls in dependence upon the knowledge of the passengers' travel habits and sensing movement of passengers into and out of the elevator corridor.

BACKGROUND ART

To improve elevator performance in delivering passengers to destination floors, recent focus has been on automatic call placement systems, typically utilizing some sort of electromagnetic transmitter to place the call. Some of the systems are passive, requiring no activity on behalf of the potential passenger to place the call. In such a case, an elevator call is placed by a transponder, such as a transmitter worn by the passenger responding to a beacon. In order to move passengers quickly out of the lobby, the calls are placed as early as possible. However, this results in placement of numerous false calls, since not all persons passing through the lobby or other elevator corridor, intend to use the elevator.

In U.S. Pat. No. 4,662,479, a measurement means tracks the position of a passenger, and places a destination call if the passenger enters the elevator, but cancels the call if the passenger wanders away from the elevator. This is extremely difficult to implement whenever there are numerous passengers.

In commonly owned U.S. patent application Ser. No. 09/189,161 filed on Nov. 9, 1998, now U.S. Pat. No. 6,109,396, a passenger proceeding toward the elevators will automatically cause a "far call" to be registered, to cause an elevator to approach the floor of the passenger, but the car does not stop unless the passenger reaches the proximity of an elevator, where a "near call" is placed for him.

DISCLOSURE OF INVENTION

Objects of the present invention include minimizing the number of false elevator calls made automatically, while allowing entry of elevator calls as early as possible.

According to the present invention, an elevator corridor having at least one route of access has a transponder beacon located near each access, to detect when potential passengers wearing coded responder units enter and leave the corridor, and a dispatching controller which either does not enter a call, or enters a call after different delays from the transponder response, due to the travel history established for the passenger, or lack thereof, and cancels calls for passengers whose responders indicate that they have left the lobby. According further to the invention, passengers are categorized as new, when there is insufficient history to determine their travel habits, and as visitors, users, and non-users. The users are those who normally enter the elevator corridor through an entrance, and expect to take an elevator right away. The non-users are those who enter the elevator corridor, but pass therethrough to some other facility, such as a cafeteria, then eventually return to the elevator corridor where their presence at a different transponder will indicate they are now ready to board an elevator. For a new passenger with no history, the call is not placed immediately, allowing time for the passenger to pass through the elevator corridor if the passenger so desires, utilizing a time delay which may be on the order of five seconds. For users, who are known to take the elevator in essentially every case, an elevator call is placed immediately, having a time delay of one-tenth of a second or less. Non-users who pass through the elevator corridor and then excite a different transponder may then be treated as users. In still further accord with the invention, the travel patterns are recognized by whether or not a call entered for a user is cancelled several times in a row, then the user will become a non-user. New passengers will be determined to be users if they do not leave the elevator corridor within five seconds after several usages of the elevator. Non-users who change their habits and do not pass through the elevator corridor for several days, but rather wait for an elevator, are converted to users. The invention relies on the electromagnetic transmissions which identify each passenger as each passenger passes by any one of the transponder beacons.

Other objects, features and advantages of the present invention will become more apparent in the light of the following detailed description of exemplary embodiments thereof, as illustrated in the accompanying drawing.

BRIEF DESCRIPTION OF THE DRAWINGS

The sole FIGURE herein is a simplified, stylized perspective of an elevator corridor employing the present invention.

BEST MODE FOR CARRYING OUT THE INVENTION

Referring to the FIGURE, an elevator corridor 5 has a pair of access paths, including an entranceway 6 and a passageway 7 that leads to a cafeteria 8. Three elevators 10–12 may each have a display 13 to indicate the destination of the corresponding elevator.

According to the invention, a plurality of transponder beacons 17, 18 are each disposed near a corresponding one of the access paths 6, 7, and these are interconnected with a dispatching controller 19. Similar transponder beacons (not shown) will be disposed on elevator corridors on other floors of the building. The transponders 17, 18 are shown as being within the elevator corridor 5, but they may be in the adjacent spaces, such as the entrance passageway leading to the access 6, or the cafeteria 8. Although only two transponder beacons 17, 18 are shown, there will in the usual course be one for each access to the elevator corridor 5.

A plurality of passengers 21–23 are each wearing a corresponding responder 24–26 which, in one embodiment of the invention, do not have on-board power, but are powered instead by received electromagnetic radiation, utilizing well-known conventional radio frequency identification (RFID) technology. When a transponder beacon 17, 18 sends a recognizable activation sequence, the responders are activated to transmit the codes stored in their memories. The transponders may be incorporated within employees' badges, pins, tags, fobs and the like. Visitors may have throw-away tags with transponders that are programmed with the authorized destination floor of the visitor, and the validity date. On the other hand, any suitable radio frequency response system may be utilized within the purview of the present invention.

As examples, consider passenger 21, who is a non-user as he passes through the portal 6 as indicated in dotted lines, because the dispatching controller 19 recognizes that passenger 21 generally does not go directly to the elevators, but rather will respond to the other transponder beacon 18 as he passes through the portal 7 into the cafeteria 8, prior to entering the elevators. Therefore, no call is entered for passenger 21 as a consequence of passing through the portal 6. However, later on, as passenger 21 passes through portal 7 and his responder again responds to the transponder beacon 18, the dispatching controller 19 will recognize that this has historically resulted in the passenger 21 entering an elevator, and therefore the dispatching controller 19 will enter the call.

As a further example, the passenger 23 has passed through the portal 6 and caused a response to the transponder beacon 17. Since the history of passenger 23 indicates that she normally takes an elevator upon entering the elevator corridor, the dispatching controller 19 will immediately enter a call for the destination floor which history has shown that passenger 23 desires to reach. However, should passenger 23 proceed to the opposite end of the elevator corridor and cause a response in transponder beacon 18, the dispatching controller will recognize the likelihood that the passenger 23 is not going to take an elevator, and cancel the previously entered call. If passenger 23 goes directly to the cafeteria 8 several times in the next few visits to the corridor, the dispatching controller 19 will change the status of passenger 23 from a user to a non-user, with respect to the first response to the transponder 17.

As a further example, the passenger 22 may be new to the building, and has no history. In such a case, the dispatching controller 19, upon receiving a response through the transponder beacon 17, will wait five seconds to see whether or not the passenger 22 passes by the responder beacon 18, or not, before placing a call. After several days, passenger 22 will have a history, and the dispatching controller 19 will enter calls accordingly. A visiting passenger, whose identity number will include an indication of the fact that such passenger is a visitor, has no history and needs none, so the dispatching controller will be set to respond in some default fashion, which can either be assumed that the passenger will enter the car immediately and therefore place a call as soon as the transponder beacon 17 senses the presence of a visitor, or the dispatching controller may be set to wait five seconds to see if the visitor passes through to the cafeteria 8 and responds to the transponder beacon 18, before entering a call.

The aforementioned patent and patent application are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator system for a building having a plurality of elevators serving a number of floors, comprising:

a plurality of elevator corridors, one for each of a plurality of said floors, each having access to said plurality of elevators, each having at least one access path through which potential elevator passengers may enter and exit the elevator corridor;

a plurality of responder beacons interconnected with said dispatching controller, each of said beacons being disposed in the immediate vicinity of a corresponding one of said access paths;

a plurality of responders, one for each potential passenger, each for responding to a request transmission received from one of said responder beacons by transmitting a response including a passenger identification code, the responder of any potential passenger who is a non-tenant visitor having an identification code identifying such potential passenger as a visitor;

a dispatching controller interconnected with said transponder beacons, for receiving signals from said beacons indicative of responses provided by passengers' responders, for recording the access path through which the passenger entered the lobby corridor and thereafter for recording the fact, if it occurs, that the same passenger has passed a different beacon transponder indicating that the passenger has left the elevator corridor, for maintaining such recordings over a period of several days to comprise a passenger travel history for passengers who do not have a visitor identification code, and, from said travel history, upon the entrance of a passenger to said elevator corridor designating a passenger as a user, likely to take the elevator immediately upon entering the elevator corridor, or as a non-user, unlikely to take the elevator in the first pass through said elevator corridor, those passengers who are new and have an insufficient history being designated as new passengers, said dispatching controller entering calls immediately for users and delaying entry of elevator calls for a small fraction of a minute for passengers who are designated as new.

2. A system according to claim 1 wherein said small fraction of a minute is on the order of five seconds.

3. A system according to claim 1 wherein:

said dispatching controller enters a call immediately for any passenger identified as a visitor.

4. A system according to claim 1 wherein:

said dispatching controller enters a call after a delay of a small fraction of a minute for any passenger identified as a visitor.

5. A system according to claim 1 wherein said dispatching controller, for a passenger who has first entered the elevator corridor through a first access path, for which the passenger was identified as a non-user, and then exits the elevator corridor through a second access path, and then reenters said elevator corridor from one of said paths, designates the passenger as a user and enters an elevator call for such passenger immediately upon reentering said elevator corridor through said one access path.

* * * * *